US007057978B2

(12) United States Patent
Pánek

(10) Patent No.: US 7,057,978 B2
(45) Date of Patent: Jun. 6, 2006

(54) TIME INTERVAL MEASUREMENT DEVICE

(75) Inventor: Petr Pánek, Otevřená 1324, 272 00 Kladno (CZ)

(73) Assignees: Petr Panek, Kladno (CZ); Pavel Lamac, Praha (CZ)

( * ) Notice: Subject to any disclaimer, the term of this patent is extended or adjusted under 35 U.S.C. 154(b) by 127 days.

(21) Appl. No.: 10/923,054

(22) Filed: Aug. 20, 2004

(65) Prior Publication Data

US 2005/0052952 A1 Mar. 10, 2005

(30) Foreign Application Priority Data

Sep. 4, 2003 (CZ) ..... 2003-2393

(51) Int. Cl.
*G04F 8/00* (2006.01)
*G04F 10/00* (2006.01)

(52) U.S. Cl. ..... 368/113; 368/118

(58) Field of Classification Search ..... 368/113, 368/118, 120

See application file for complete search history.

(56) References Cited

U.S. PATENT DOCUMENTS

| | | | | |
|---|---|---|---|---|
| 4,678,345 | A * | 7/1987 | Agoston | 368/119 |
| 5,027,298 | A * | 6/1991 | Khazam | 702/176 |
| 5,903,523 | A * | 5/1999 | Peck | 368/202 |
| 2006/0002239 | A1 * | 1/2006 | Gage et al. | 368/118 |

* cited by examiner

*Primary Examiner*—Vit W. Miska
(74) *Attorney, Agent, or Firm*—Egbert Law Offices

(57) ABSTRACT

A device for high accurate measurement of time intervals is based on the conversion of the time interval to a sequence of samples of the response of a surface acoustic wave filter excited at the beginning and at the end of the measured interval. In one of its configurations, the time interval measurement device includes the input of the pulse signal, the filter exciter, the surface acoustic wave filter, the amplifier, the sampler, the analog-to-digital converter, the sample register, the register of sample numbers, the voltage comparator, the control circuit, the sample counter, the computer, the output of the reference clock signal source, and the output of the measured time intervals.

6 Claims, 2 Drawing Sheets

TIME INTERVAL MEASUREMENT DEVICE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The invention deals with a device that allows accurate measurement of time intervals.

BACKGROUND OF THE INVENTION

A comprehensive overview of traditional methods of time interval measurement is given, for instance, in the paper: D.I. Porat, "Review of sub-nanosecond time-interval measurements," IEEE Transactions on Nuclear Science, vol. 20, no. 5, pp. 36–51.

The most widespread method of time interval measurement is based on a counter that counts reference clock pulses. The dynamic range of the measured interval increases almost exponentially with counter length and is practically unlimited. Resolution of this method is given by the reference clock frequency, which is mainly limited by the speed of the digital circuitry in the counter. This is why the resolution of the counter is not usually better than 1 ns. The measurement accuracy is determined by the accuracy of the reference clock frequency. Thanks to their wide dynamic range and good integral linearity, digital counters are the basis of all methods of time interval measurement with the exception of the measurement of very short time intervals. However, appropriate techniques need to be used to improve their resolution.

A simple method of improving the resolution is the use of several synchronous, phase-shifted clock signals connected to several counters. The accuracy of this method is limited by the accuracy and stability of the phase shift between the individual clock signals.

Substantial improvement of the counter resolution may be achieved by using an analog interpolator, which works on the principle of measurement of the voltage increase on an integrator charged during the measured interval. The interpolator ensures measurement of short intervals from the beginning and the end of the measured interval until the next clock pulse. A simple integrating interpolator, which converts the voltage increase to the time necessary for integrator discharge and thus requires no separate analog-to-digital converter, is often used. Due to the temperature instability of the integration time constant, the integrating interpolator has to be calibrated continuously. Its accuracy is limited by the noise and disturbances in the integrator circuitry, and by the non-linearity of the integrator.

Further interpolation methods are based on the Vernier principle. These methods usually use oscillators started at the beginning and at the end of the measured interval. The oscillator frequency is slightly deviated from the reference clock frequency. The interpolation is based on the measurement of the time elapsed from starting the oscillator until reaching a phase coincidence with the reference clock signal. The resolution is inversely proportional to the frequency deviation of the oscillators. The accuracy is mainly limited by the frequency instability and by the phase fluctuations of the started oscillators.

Recently, interpolation methods based on the propagation of a pulse through a delay line have been developed. The fundamentals of these methods and some of their applications are described, for instance, in the paper: T. E. Rahkonen et al., "The Use of Stabilized CMOS Delay Lines for the Digitization of Short Time Intervals," IEEE Journal of Solid-State Circuits, vol. 28, no. 8, pp. 887–894 and in the paper: M. Mota et al.: "A High-Resolution Time Interpolator based on a Delay Locked Loop and an RC Delay Line," IEEE Journal of Solid-State Circuits, vol. 34, no. 10, pp. 1360–1366.

The principle of the use of the delay line is as follows: pulses are supplied to the delay line that consists of numerous identical elements. The logical levels at the outputs of the individual elements are read at the beginning and at the end of the measured interval. The interval length is determined from the number of the elements through which the pulse has passed during the measured time. Due to the temperature dependence of the delay, continuous calibration of the delay line against the reference clock signal is required. The delay in the individual elements can also be maintained at the nominal value by means of PLL or DLL. When PLL is used, the delay line is connected into a ring oscillator. The line delay is controlled so that the ring oscillator remains synchronized with the reference clock signal. In the case of DLL, the delay line is fed by the reference clock signal. The line delay is controlled so as to maintain the input and output signals in phase. The resolution of these methods is given by the delay of the individual elements. If the delay line is based on modern CMOS technology, the resolution is usually in the order of 100 ps.

There are several ways to improve the resolution beyond this limit. One of the possibilities is, once again, the use of the Vernier principle. In this case, two delay lines with a slightly different delay in the individual elements are used, and it is noted on which pair of elements of both delay lines a coincidence of the propagated signals occurs. Another possibility is the use of an array of delay lines that are fed by signals with different delays. This may be achieved, for instance, by feeding the delay line from another delay line tapped at different points and stabilized by DLL or by connecting the array into a multiphase ring oscillator stabilized by PLL. The accuracy of the interpolation by means of the delay line is primarily limited by the differences in the delays of the individual elements. Good linearity may be achieved only if all the line elements have the same delay, which leads to the requirement that the topology of the elements is identical. However, the above condition is difficult to meet in designing the delay line. In the design of the ring delay line it is practically impossible. The accuracy is further limited by the fast components of the noise in the delay line, which cannot be reduced by DLL or PLL stabilization.

BRIEF SUMMARY OF THE INVENTION

The above disadvantages are eliminated by the time interval measurement device according to the present invention. In its first basic configuration, it is made up of an input of the pulse signal connected through a serial chain, which consists of a filter exciter, a surface acoustic wave filter, and an amplifier, to the analog input of a sampler. The output of the sampler is connected to the analog input of an analog-to-digital converter, the output of which is connected to the digital input of a sample register. The output of the sample register is connected to the first input of the computer. The input of the pulse signal is further connected through a voltage comparator to the trigger input of a control circuit, one of whose write outputs is connected to the write input of the sample register while the other write output is connected to the write input of a register of sample numbers. The output of the register of sample numbers is connected to the second input of the computer. The output of the sample counter is connected to the digital input of the register of sample numbers. The input of the sample counter, together with the trigger input of the analog-to-digital converter, the sampling input of the sampler, and the clock input of the control circuit are connected to the output of the source of the reference clock signal. The output of the computer is the output of the measured time intervals.

In one modification, this first basic configuration is arranged so that the input of the pulse signal is connected to the input of the filter exciter through a switch equipped with the second input of the pulse signal and with a control input that is connected to the switching output of the control circuit.

In another modification, the basic configuration is arranged so that the control circuit is equipped with an excitation output connected to the second input of the filter exciter, and the device further comprises a second branch. This second branch is made up of the second input of the pulse signal connected through a serial chain which consists of the second filter exciter, the second surface acoustic wave filter, and the second amplifier to the analog input of the second sampler. The output of the second sampler is connected to the analog input of the second analog-to-digital converter, the output of which is connected to the digital input of the second sample register. The output of the second sample register is connected to the third input of the computer. The second input of the pulse signal is further connected through the second voltage comparator to the trigger input of the second control circuit. Its excitation output is connected to the second input of the second filter exciter and one of its write outputs is connected to the write input of the second sample register while the second write output is connected to the write input of the second register of sample numbers. The output of the second register of sample numbers is connected to the fourth computer input. The output of the sample counter is connected to the digital input of the second register of sample numbers. The trigger input of the second analog-to-digital converter, the sampling input of the second sampler, and the clock input of the second control circuit are connected to the output of the source of the reference clock signal.

In the second basic configuration, the time interval measurement device is made up of an input of the pulse signal connected through a voltage comparator to a serial chain which consists of a filter exciter, a surface acoustic wave filter, and an amplifier to the analog input of a sampler. The output of the sampler is connected to the analog input of an analog-to-digital converter, whose output is connected to the digital input of a sample register, the output of which is connected to the first input of the computer. The output of the voltage comparator is further connected to the trigger input of the control circuit, one write output of which is connected to the write input of the sample register while the second write output is connected to the write input of the register of sample numbers. The output of the register of sample numbers is connected to the second input of the computer and the digital input of the register of sample numbers is connected to the output of the sample counter. The input of the sample counter together with the trigger input of the analog-to digital converter, the sampling input of the sampler, and the clock input of the control circuit are connected to the output of the source of the clock reference signal. The output of the computer is the output of the measured time intervals.

In one modification of this second basic configuration, the voltage comparator is connected to the input of the filter exciter through a switch whose second input is connected to the output of the second voltage comparator which has a second input of the pulse signal and whose control input is connected to the switching output of the control circuit.

In another modification, the device is arranged so that the control circuit is equipped with an excitation output connected to the second input of the filter exciter, and the device comprises a second branch. This second branch is made up of the second input of the pulse signal connected through the second voltage comparator and a serial chain which consists of the second exciter, the second surface acoustic wave filter, and the second amplifier to the analog input of the second sampler. The output of the second sampler is connected to the analog input of the second analog-to-digital converter, the output of which is connected to the digital input of the second sample register. The output of the second sample register is connected to the third input of the computer. The output of the second voltage comparator is further connected to the trigger input of the second control circuit, the excitation output of which is connected to the second input of the second filter exciter, and further one of its write outputs is connected to the write input of the second sample register and the second write output is connected to the write input of the second register of sample numbers. The output of the second register of sample numbers is connected to the fourth input of the computer, and its digital input is connected to the output of the sample counter. The trigger input of the second analog-to-digital converter, the sampling input of the second sampler, and the clock input of the second control circuit are connected to the output of the source of the reference clock signal.

The invention is intended for accurate measurement of the time interval between events represented by pulse signals. Its principle of operation is based on the conversion of measurement of a time interval to measurement of a sequence of samples of the response of a surface acoustic wave filter excited at the beginning and at the end of the measured interval. The advantage of the invention is the possibility to measure the time intervals with high accuracy and with practically unlimited dynamic range and resolution. The high accuracy may be achieved with relatively low clock frequency and thus not very high demand for the speed of the digital circuits used and the analog-to-digital converter.

Converting the measurement of the time interval into the measurement of a sequence of many samples allows various measurement errors to be reduced by using post-processing based on the cross-correlation technique. It can be demonstrated that the errors caused by phase noise in the clock signal and in the sampler are reduced by increasing the sampling frequency and the duration of the filter response. In turn, the errors caused by the sample quantization in the analog-to-digital converter and by an additive noise in the filter response are reduced by increasing the mean frequency and the energy of the filter response. Thus, by using a filter with appropriate parameters, a high-enough sampling frequency, and a low-jitter sampler, it is possible to achieve a very high level of accuracy, which is otherwise very difficult to achieve using current methods.

BRIEF DESCRIPTION OF THE SEVERAL VIEWS OF THE DRAWINGS

The attached schematic drawings show examples of the time interval measurement device according to the present invention.

DETAILED DESCRIPTION OF THE INVENTION

Figure 1:
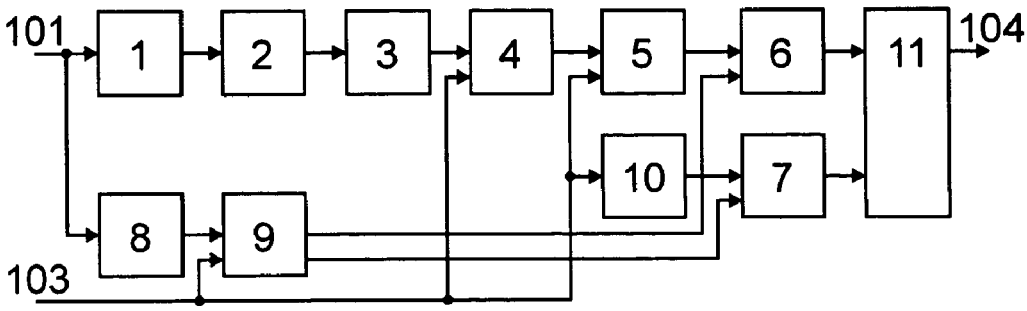
FIG. 1 is a diagrammatic illustration showing a block diagram of the first basic configuration.
Figure 2:
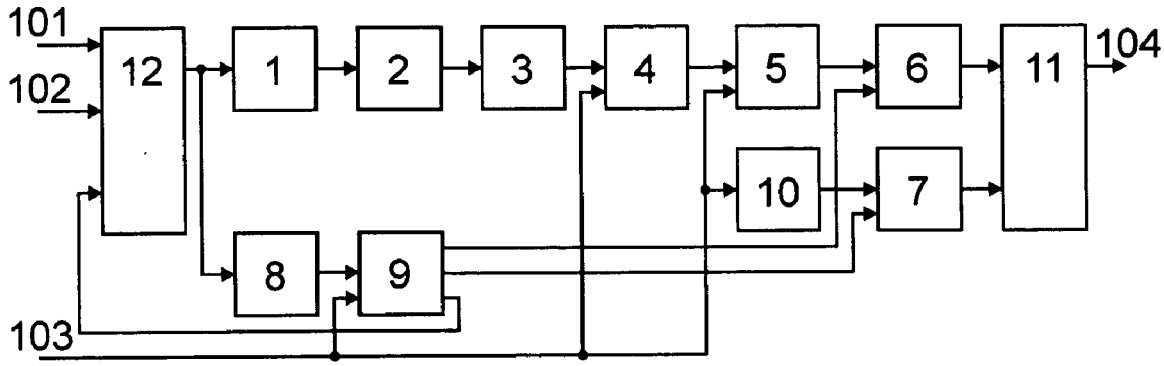
FIGS. 2 and 3 are also diagrammatic illustrations showing modifications of the first configuration.
Figure 3:
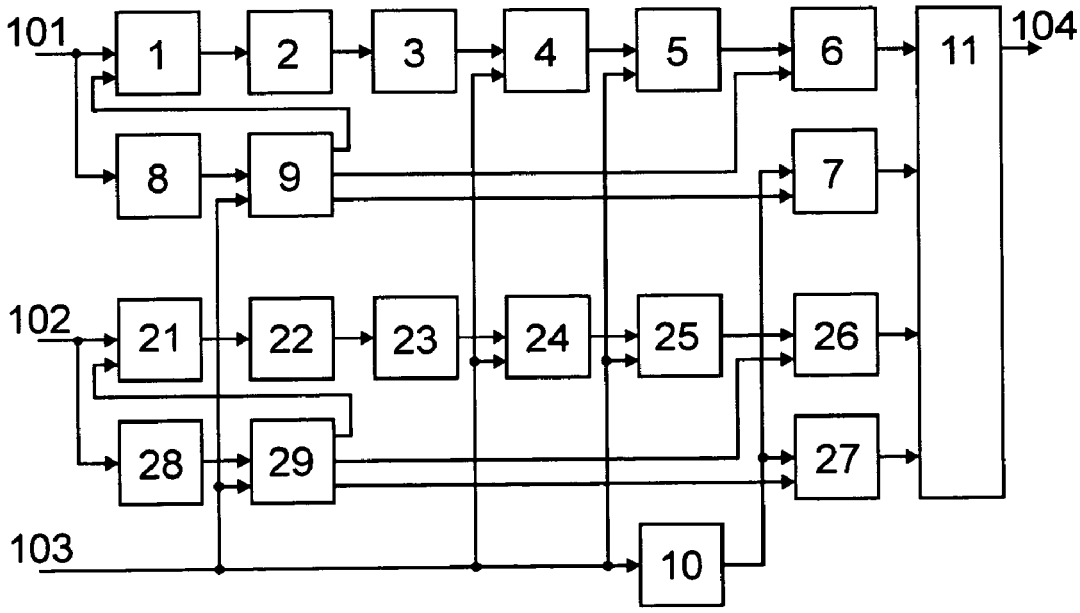

The devices in the FIG. 1, FIG. 2, and FIG. 3 serve for measurement of time interval between two pulse signals that are identical or similar in shape, but may have different amplitude. They may originate, for instance, from a particle detector, a photo-detector, or a radio receiver detector.

FIG. 1 shows an example of the first basic configuration of the time interval measurement device. This device is made up of an input 101 of the pulse signal connected through a serial chain, which consists of a filter exciter 1, a surface acoustic wave filter 2, which is a bandpass filter with a finite pulse response, and an amplifier 3, to the analog input of a sampler 4. The output of the sampler 4 is connected to the analog input of an analog-to-digital converter 5, the output of which is connected to the digital input of a sample register 6. The output of the sample register 6 is connected to the first input of the computer 11. The input 101 is further connected through a voltage comparator 8 to a trigger input of a control circuit 9, one of whose write outputs is connected to the write input of the sample register 6 while the other write output is connected to the write input of a register 7 of sample numbers. The output of the register 7 of sample numbers is connected to the second input of the computer 11. The output of the sample counter 10 is connected to the digital input of the register 7 of sample numbers. The input of the sample counter 10 together with the trigger input of the analog-to-digital converter 5, the sampling input of the sampler 4, and the clock input of the control circuit 9 are connected to the output 103 of the source of the reference clock signal. The output 104 of the computer 11 is the output of the measured time intervals.

The sampler 4 is triggered by the reference clock signal with frequency $f_s$ which is chosen to meet the condition $$\frac{2f_0 + B}{M + 1} \le f_s \le \frac{2f_0 - B}{M}$$

where $f_0$ is the central frequency of the filter 2, B is the bandwidth of the filter 2, and M is an integer number from the range:

$$0 \le M \le \frac{f_0}{B} - \frac{1}{2}$$

The sample counter 10 is incremented with each sample. The samples are converted by the analog-to-digital converter 5 to digital form.

Both input pulse signals actuate the input 101. Upon arrival of the first input pulse signal, the surface acoustic wave filter 2 is excited and at the same time, the voltage comparator 8 triggers the control circuit 9, which writes the sequence of n response samples to the sample register 6. The number of recorded samples must meet the condition:

$$n > \tau_R f_s$$

where $\tau_R$ is the duration of the response of the surface acoustic filter 2 to the input pulse signal. The control circuit 9 also writes the ordinal number of the first sample of the recorded sequence from the sample counter 10 to the register 7 of sample numbers. Upon arrival of the second input pulse signal, the surface acoustic wave filter 2 is excited once again and the response samples and the ordinal number of the first sample are also written to registers 6 and 7, respectively. The two recorded sequences of the response samples and the ordinal numbers of the first samples are then processed by the computer 11. As a result of the above conditions, the responses may be unambiguously reconstructed in the computer 11 by interpolation from the finite number of the response samples of the filter 2. By finding the maximum of their cross-correlation, their mutual time shift can be determined, which also represents the desired time interval between the first and the second pulse signals.

The device in FIG. 2 serves for measurement of time interval between two pulse signals connected to two inputs 101 and 102. Both the inputs lead to switch 12 which is controlled by the control circuit 9. The rest of the device does not differ from that in FIG. 1. At the beginning of the measurement, the switch 12 is switched to the first input 101. Upon arrival of the first input pulse signal, the surface acoustic wave filter 2 is excited and the response samples together with the ordinal number of the first sample are written to registers 6 and 7, respectively. After that, the control circuit 9 switches the switch 12 to the second input 102. Upon arrival of the second input pulse, the surface acoustic wave filter 2 is excited once again and the response samples are also written to registers 6 and 7, respectively. The two recorded sequences of the response samples and the ordinal numbers of the first samples are then processed by the computer 11 and the time interval is determined.

The devices in FIG. 1, and FIG. 2 are not capable of measuring intervals shorter than the duration of the response of the surface acoustic wave filter 2 to the input pulse signal. Also the time succession of the first and the second pulses must be met. This means that the devices are not suitable for measurement of very short intervals or negative delays. These limitations are eliminated by the device in FIG. 3, which serves for measurement of a time interval between two input pulse signals with no conditions for the time interval length and the time succession of the input signals.

This device is also based on the first basic configuration in FIG. 1. However, now the control circuit 9 is equipped with an excitation output connected to the second input of the filter exciter 1, and the device further comprises a second branch which consists of the second input 102 of the pulse signal connected through a serial chain which consists of the second filter exciter 21, the second surface acoustic wave filter 22, and the second amplifier 23 to the analog input of the second sampler 24. The output of the second sampler 24 is connected to the analog input of the second analog-to-digital converter 25, the output of which is connected to the digital input of the second sample register 26. The output of the second sample register 26 is connected to the third input of the computer 11. The second input 102 of the pulse signal is further connected through the second voltage comparator 28 to the trigger input of the second control circuit 29. Its excitation output is connected to the second input of the second filter exciter 21 and one of its write outputs is connected to the write input of the second sample register 26 and the second write output is connected to the write input of the second register 27 of sample numbers. The output of the second register 27 of sample numbers is connected to the fourth input of the computer 11. The output of the sample counter 10 is connected to the digital input of the second register 27 of sample numbers. The trigger input of the second analog-to-digital converter 25, the sampling input of the second sampler 24, and the clock input of the second control circuit 29 are connected to the output 103 of the source of the reference clock signal.

Upon arrival of the first input pulse signal, the surface acoustic wave filter 2 is excited and the voltage comparator 8 triggers the control circuit 9, which writes the sequence of n response samples to the sample register 6. At the same time, the control circuit 9 writes the ordinal number of the first sample of the recorded sequence from the sample counter 10 to the register 7 of sample numbers. After all n samples are recorded, the control circuit 9 triggers the filter exciter 1 synchronously with the reference clock signal and the filter exciter 1 excites the surface acoustic wave filter 2. The control circuit 9 then writes next n samples to the sample register 6. Upon arrival of the second input pulse signal, the second surface acoustic wave filter 22 is excited and the second voltage comparator 28 triggers the second control circuit 29, which writes the sequence of n response samples to the second sample register 26. At the same time, the second control circuit 29 writes the ordinal number of the first sample of the recorded sequence from the sample counter 10 to the second register 27 of sample numbers. After all n samples are recorded, the second control circuit 29 triggers the second filter exciter 21 synchronously with the reference clock signal and the second filter exciter 21 excites the second surface acoustic wave filter 22. The second control circuit 29 then records next n samples to the second sample register 26. The recorded sequences of response samples and the ordinal numbers of the first samples are then processed by the computer 11 and the time interval is determined.

The beginning and the end of the measured interval is often related to particular voltage levels of the input pulse signals. The devices for measurement of intervals defined in this way are in FIG. 4, FIG. 5, and FIG. 6.

Figure 4:
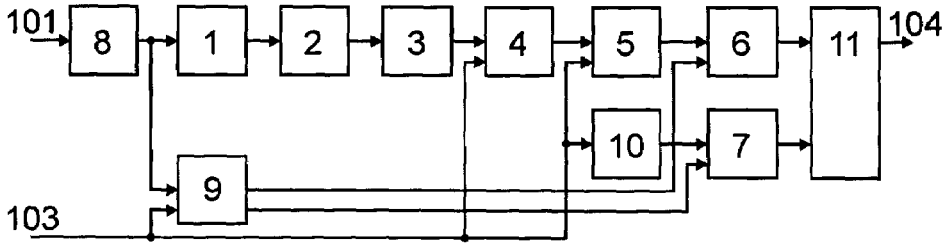
FIG. 4 is a diagrammatic illustration showing a block diagram of the second basic configuration.

The basic configuration in FIG. 4 only differs from that in FIG. 1 by the fact that the output of the filter exciter 1 is connected to the input of the voltage comparator 8. Its operation is identical with that of the device in FIG. 1, but the excitation of the surface acoustic wave filter 2 and the record of the response samples only occur after the input pulse signal on input 101 exceeds the trigger level of the voltage comparator 8.

Figure 5:
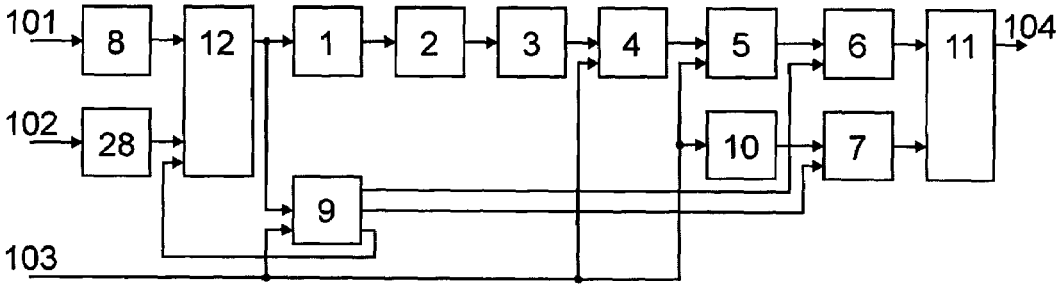
FIGS. 5 and 6 are also diagrammatic illustrations showing modifications of the second configuration.

The device in FIG. 5 serves for measurement of time interval between two input pulse signals connected to two different inputs 101 and 102. The first input 101 leads to the voltage comparator 8. The second input 102 leads to the second voltage comparator 28. Outputs of the voltage comparator 8 and of the second voltage comparator 28 are connected to the switch 12 which is controlled by the control circuit 9. The rest of the device does not differ from that in FIG. 4. The operation of the device is identical with that of the device in FIG. 2, but the excitation of the surface acoustic wave filter 2 and the record of response samples only occur after the input pulse signal on the input 101 exceeds the trigger level of the voltage comparator 8, or the input pulse signal on the input 102 exceeds the trigger level of the voltage comparator 28.

Figure 6:
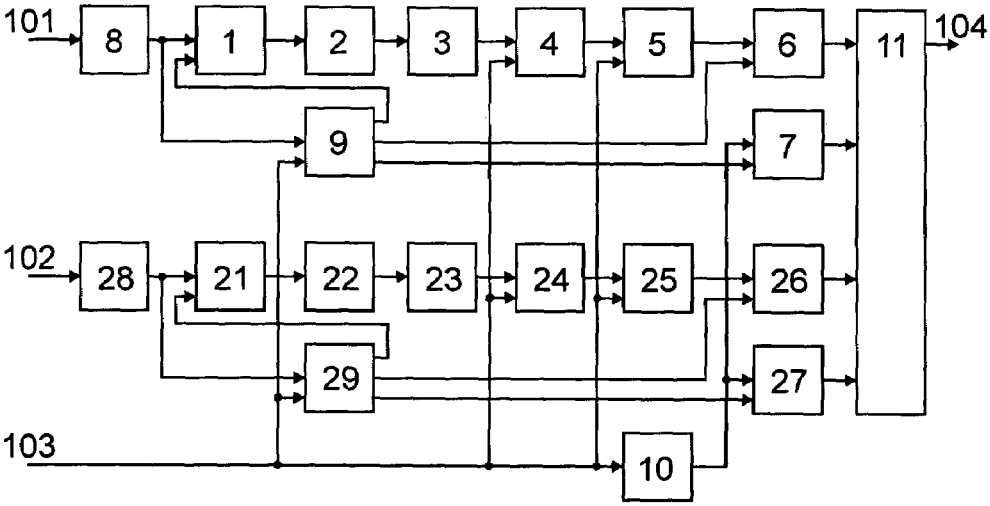

The device in FIG. 6 allows the measurement of a time interval between two input pulse signals connected to two different inputs with no conditions for the time interval length or time succession of the input signals. The device differs from the one in FIG. 3 only by the fact that the input of the filter exciter 1 is now connected to the output of the voltage comparator 8 and the input of the filter exciter 21 is now connected to the output of the voltage comparator 28. The operation of the device is identical with that of the device in FIG. 3, but the excitation of the surface acoustic wave filter 2 and the record of response samples occur only after the input pulse signal on input 101 exceeds the trigger level of the voltage comparator 8, or the input pulse signal on input 102 exceeds the trigger level of the voltage comparator 28.

INDUSTRIAL APPLICABILITY

The device according to the present invitation can be used in apparatuses for nuclear technology, chemical analysis, and medical diagnostics, in laser, radio and ultrasound distance measurement systems, radars, lidars, and sonars, TDOA location systems, apparatuses for testing integrated circuits, time-to-digital converters, and time and frequency measurement devices.

I claim:

1. A time interval measurement device comprising:

input of a pulse signal connected to a serial chain comprised of a filter exciter connected through a surface acoustic wave filter and an amplifier to an analog input of a sampler, an output of said sampler being connected to an analog input of an analog-to-digital converter, an output of said converter being connected to a digital input of a sample register, an output of said sample register being connected to a first input of a computer, while said input of said pulse signal is further connected through a voltage comparator to a trigger input of a control circuit, a first write output of said control circuit being connected to a write input of said sample register, and a second write output connected to a write input of a register of sample numbers, whose output connects to a second input of the computer, and a digital input of a register of sample numbers connected to an output of the sample counter, the input of the sample counter together with the trigger input of the analog-to-digital converter, the sampling input of the sampler, and a clock input of the control circuit connect to an output of a reference clock signal source, and an output of the computer being an output of measured time intervals.

2. The device according to claim 1, wherein said input of the pulse signal is connected to the input of the filter exciter through a switch having the second input of the pulse signal, the control input being connected to the switching output of the control circuit.

3. The device according to claim 1, wherein said control circuit is comprised of an excitation output connected to the second input of the filter exciter, and wherein said device further comprises a second branch comprised of a second input of the pulse signal connected to a serial chain with a second filter exciter connected through a second surface acoustic wave filter and a second amplifier to the analog input of a second sampler, an output of the second sampler being connected to an analog input of a second analog-to-digital converter, an output of which is connected to a digital input of a second sample register, an output of said second sample register being connected to a third input of the computer, while the second input of the pulse signal is further connected through a second voltage comparator to a trigger input of the second control circuit, the excitation output of said second control circuit being connected to the second input of the second filter exciter, and a first write output connected to a write input of the second sample register, and a second write output is connected to a write input of a second register of sample numbers, an output of the second register of sample numbers being connected to a fourth input of the computer, and a digital input of the second register of sample numbers being connected to an output of the sample counter, while a trigger input of the second analog-to digital converter, the sampling input of the second sampler, and a clock input of the second control circuit are connected to an output of the reference clock signal source.

4. A time interval measurement device comprising:

input of a pulse signal connected through a voltage comparator to a serial chain comprised of a filter exciter connected through a surface acoustic wave tilter and an amplifier to an analog input of a sampler, the output of the sampler connected to an analog input of an analog-to-digital converter, the output of the converter connected to the digital input of a sample register, the output of the sample register connected to the first input of a computer, while the output of the voltage comparator is further connected to a trigger input of a control circuit, a first write output of the control circuit connected to a write input of the sample register, and a second write output connected to a write input of a register of sample numbers, whose output is connected to a second input of the computer, and a digital input of the register of sample numbers connected to the output of a sample counter, the input of the sample counter together with the trigger input of the analog-to-digital converter, the sampling input of the sampler, and a clock input of the control circuit being connected to an output of a reference clock signal source, while an output of the computer being an output of the measured time intervals.

5. The device according to claim 4, wherein said voltage comparator is connected to the input of the filter exciter through a switch whose second input is connected to the output of a second voltage comparator which receives a second pulse signal at an input thereof, and wherein a control input of the switch is connected to a switching output of the control circuit.

6. The device according to claim 4, wherein said control circuit is comprised of an excitation output connected to a second input of the filter exciter, and wherein the device further comprises:

a second branch having a second input of the pulse signal connected through a second voltage comparator to a serial chain comprised of a second filter exciter connected through a second surface acoustic wave filter and a second amplifier to an analog input of a second sampler, an output of the second sampler connected to an analog input of a second analog-to-digital converter, an output of the converter connected to a digital input of a second sample register, the output of the second sample register connected to a third input of the computer, while an output of the second voltage comparator is further connected to a trigger input of a second control circuit, and an excitation output of the second control circuit connected to a second input of a second filter exciter, and one write output of the second control circuit connected to a write input of the second sample register and a second write output is connected to the write input of a second register of sample numbers, the output of the second register of sample numbers connected to a fourth input of the computer, and a digital input of the second register of sample numbers connected to the output of the sample counter, while the trigger in put of the second analog-to-digital converter, the sampling input of the second sampler, and a clock input of the second control circuit are connected to the output of the reference clock signal source.

* * * * *

UNITED STATES PATENT AND TRADEMARK OFFICE

CERTIFICATE OF CORRECTION

PATENT NO. : 7,057,978 B2
APPLICATION NO. : 10/923054
DATED : June 6, 2006
INVENTOR(S) : Petr Pánek It is certified that error appears in the above-identified patent and that said Letters Patent is hereby corrected as shown below:

Title page,
Item [75], Inventor, please delete " Otevřená " and substitute therefor --Otevřená--.

Col 9, line 36,
please delete "tilter" and substitute therefor --filter--.

Col 10, line 44,
please delete "in put" and substitute therefor --input--.

Signed and Sealed this

Seventeenth Day of October, 2006

JON W. DUDAS
*Director of the United States Patent and Trademark Office*